US005257659A

United States Patent [19]

Maag

[11] Patent Number: 5,257,659

[45] Date of Patent: Nov. 2, 1993

[54] CONTINUOUS CASTING MOLD

[75] Inventor: Helmut Maag, Waldbüttelbrunn, Fed. Rep. of Germany

[73] Assignee: Mannesmann Aktiengesellschaft, Dusseldorf, Fed. Rep. of Germany

[21] Appl. No.: 772,845

[22] Filed: Oct. 8, 1991

[30] Foreign Application Priority Data

Oct. 11, 1990 [DE] Fed. Rep. of Germany ..... 4032521

[51] Int. Cl.[5] ..... B22D 11/124

[52] U.S. Cl. ..... 164/443

[58] Field of Search ..... 164/485, 443, 486, 418, 164/444

[56] References Cited

U.S. PATENT DOCUMENTS 3,630,270 12/1971 Adamec ..... 164/443
4,774,996 10/1988 Ahrens et al. ..... 164/443

FOREIGN PATENT DOCUMENTS 0058962 4/1982 Japan ..... 164/444
0028050 2/1987 Japan ..... 164/443
0248912 8/1986 U.S.S.R. ..... 164/443
0273044 8/1986 U.S.S.R. ..... 164/443

*Primary Examiner*—Mark Rosenbaum
*Assistant Examiner*—James Miner
*Attorney, Agent, or Firm*—Cohen, Pontani, Lieberman, Pavane

[57] ABSTRACT

The present invention relates to a continuous casting mold defining a mold cavity for the casting of metal, in particular for the casting of nonferrous metal strips, having a mold wall surrounded by at least one coolant-conducting channel, having coolant connections arranged on the channel. In order to create a continuous casting mold which permits simple adjustment of the cooling conditions, both in the longitudinal direction and in circumferential direction of the ingot, with due consideration of, for instance, the speed of casting and the temperature of the melt or the metal alloy being cast, a stopper which corresponds to the cross section of the channel is arranged in the channel, and is displaceable therein, in order to vary the length of the channel subject to the effect of the coolant. The coolant connections are arranged on the same side of the stopper, outside the path of displacement of the stopper, so that a coolant circuit is always present, which is controlled in length by the position of the stopper.

12 Claims, 2 Drawing Sheets

CONTINUOUS CASTING MOLD

FIELD OF THE INVENTION

The present invention relates to a continuous casting mold for the casting of metal, particularly for the casting of nonferrous metal strips, in a mold having a mold wall which defines a mold cavity and is surrounded by at least one coolant-conducting channel having coolant connections arranged on the channel.

BACKGROUND OF THE INVENTION

Federal Republic of Germany Patent document OS 19 14 300, which is herein incorporated by reference, relates to a mold for the continuous casting of metal which has cooling channels arranged in the mold wall. The cooling channels extend approximately parallel to the direction of casting and are provided in the vicinity of their ends with laterally arranged coolant connections. Adjustment or any change of the cooling conditions is possible in the case of this mold only by changing the parameters of the coolant, such as, for instance, the initial coolant temperature and velocity of flow.

Federal Republic of Germany Patent 29 44 175 C2, which is herein incorporated by reference, discloses a continuous casting mold having a mold block which defines a mold cavity. This block is preferably made of graphite. Bore holes, which extend parallel to the direction of casting, are formed in the mold block, from the side from which the solidified bar emerges. Cooling rods through which coolant flows can be inserted in the bore holes at variable depths. Each cooling rod consists of an inner tube and of an outer tube which is closed at one end and surrounds the inner tube, thus forming a coaxial flow path. On the side facing away from the closed end of the outer tube, the inner and outer tubes are provided with coolant connections. The coolant flows into the inner tube through a connection, through the inner tube, is deflected at its end, and flows back again through the outer tube, to an exit connection. By the adjusting the location of the longitudinally displaceable cooling rods the solidification front of the melt which enters the mold can be shifted along the direction of displacement. This allows a single mold cavity having regions of different diameter in the direction of casting, with the solidification front controlled by the displacement of the cooling rods to produce bars of different dimensions without changing the mold and without interrupting the casting operation.

The structure of Federal Republic of Germany Patent 29 44 175 C2 is disadvantageous, however, because the depth of insertion of the cooling rods may be changed only from the bar emergence side of the mold, which interferes with handling and immediate guidance of the emerging hot bar, due to the size of the displacement mechanism, and because the presence of the emerging bar substantially limits the handling of the cooling tubes. Thus neither the cooling apparatus nor the bar handling apparatus are optimal.

OBJECTS OF THE PRESENT INVENTION

The object of the present invention is to provide a continuous casting mold which permits simple adjustment of the cooling conditions both in the longitudinal direction and the circumferential direction of the bar, with due consideration of, for instance, the speed of casting and of the temperature of the melt or of the particular metal alloy which is being cast.

SUMMARY OF THE INVENTION

The present invention overcomes the limitations of the prior methods by employing a continuous casting mold which comprises a displaceable stopper in a cooling channel, which is adapted to the cross section of the channel, in order to change the length of the channel traversed by the flowing coolant. The coolant connections are arranged outside the path of displacement of the stopper, and away from the region of the cast metal emergence.

In accordance with the present invention, the displacement of the stopper in the longitudinal direction of the cooling channel, in a direction parallel to the path of the melt and cast metal, produces a change in the length of the cooling channel through which coolant flows. The alignment of the cooling channels in the direction of casting, in combination with the displaceable stopper, facilitates the displacement of the solidification front of the melt in the direction of casting. This fact is particularly advantageous when casting with a directly applied so-called "hot top", since solidification of the melt at the outlet of the hot top, in the event of an excessively cooled mold is avoided. In this way, the quality of the surface of the cast bar is optimized, while at the same time the refractory lining of the hot top is spared from unwanted solidification at that region. The same advantages are also obtained upon horizontal casting with the receiver vessel arranged directly in front of the mold. When the above-described mold arrangement is used for the casting of nonferrous metals, the advantageous effect of the displacement of the solidification front, which has been heretofore described, is enhanced, since nonferrous metals generally solidify faster than steel, due to their better heat conduction properties.

The present invention allows for the adjustment of the cooling conditions in the circumferential direction of the mold. For example, in the case of continuous casting molds having a rectangular mold cross section, a plurality of cooling channels longitudinally aligned and arranged parallel alongside each other are present. By displacing the stoppers, which are arranged in the edge regions of the mold, in the direction of casting (i.e. shorter cooling channels), the heat exchange surface between the mold and the cooling fluid is reduced, and the bar remains hotter for a longer duration. Thus, tearing of the edges of the bar is successfully avoided. It should be realized that, by arranging the cooling channels in the mold, and adjusting the depth of the stopper location, the mold may be optimized for other cross sections. Further, the cooling system of the present invention may be combined with other known cooling methods, if desired.

This stopper, with a connected tube and at least one opening in the vicinity of the region of the connection between the tube and stopper results in a positive guidance of the coolant and defines a flow path. The coolant flows, for instance, via an external coolant connection into the tube, through the tube and leaves the tube through an opening at its end, in the vicinity of the stopper. The coolant then flows through a cooling channel outside the tube to another external coolant connection outside the mold. If the coolant is conducted in the direction of flow as described above, i.e. with a coaxial entrance and return path, there is assurance that the coolant will be coldest at the place where the largest amount of heat must be removed from the bar via the wall of the mold. The cooling operation may be controlled by methods known in the art, and may employ various sensors and feedback schemes.

The coolant, which is generally water, tends to have any dissolved gas separated from it due to the strong heating from the mold. This gas coalesces into a bubble, which forms a heat-insulating gas cushion below the stopper, in the case of vertically arranged cooling channels. The flow of coolant through the opening, however, prevents this disturbing gas cushion from accumulating and occupying a large volume. Thus, the flow of coolant is important during mold operation.

The displacement means for positioning the stopper exerts a force on the stopper which is opposed by the effect of the pressurized coolant on the stopper. Therefore, the displacement means need only apply a tensile force and can be constructed of a flexible rope or cable which applies a pulling force on the stopper, allowing the hydraulic pressure of the fluid to push the stopper. The rope or cable leading out of the mold as a flexible displacement means reduces the structural length of the mold and control assembly, and thereby permits direct guidance of the molded bar at the side of the mold where the bar emerges, without interference from the cooling control device. Furthermore, the displaceable stopper of the present invention allows a change in the cooling conditions to be made during the casting process, as well as allowing the mold to be adapted to a change in the metal alloy to be cast or the speed of casting.

If no changes in the cooling conditions during the casting operation are desired, then, in another embodiment, the position of the stopper may be adjusted via a helical threaded connection, rather than via the flexible displacement means of the aforementioned embodiment. In this embodiment, a thread is arranged on the tube extending from the stopper, which engages a thread which is cut in the wall of a narrower region of the channel. The displacement of the stopper in the longitudinal direction of the channel is thus adjusted by turning its threaded portion.

It is of course realized that the stopper could be threaded in the wider region of the channel to effect adjustments. It is also realized that the helical screw adjustment method does not preclude adjustments during the casting operation, and known mechanisms can be employed to rotate the stopper-tube assembly during casting, if desired.

BRIEF DESCRIPTION OF THE DRAWINGS

The present invention will be explained further with reference to the drawings, in which.

DETAILED DESCRIPTION OF THE PREFERRED EMBODIMENTS

Figure 1:
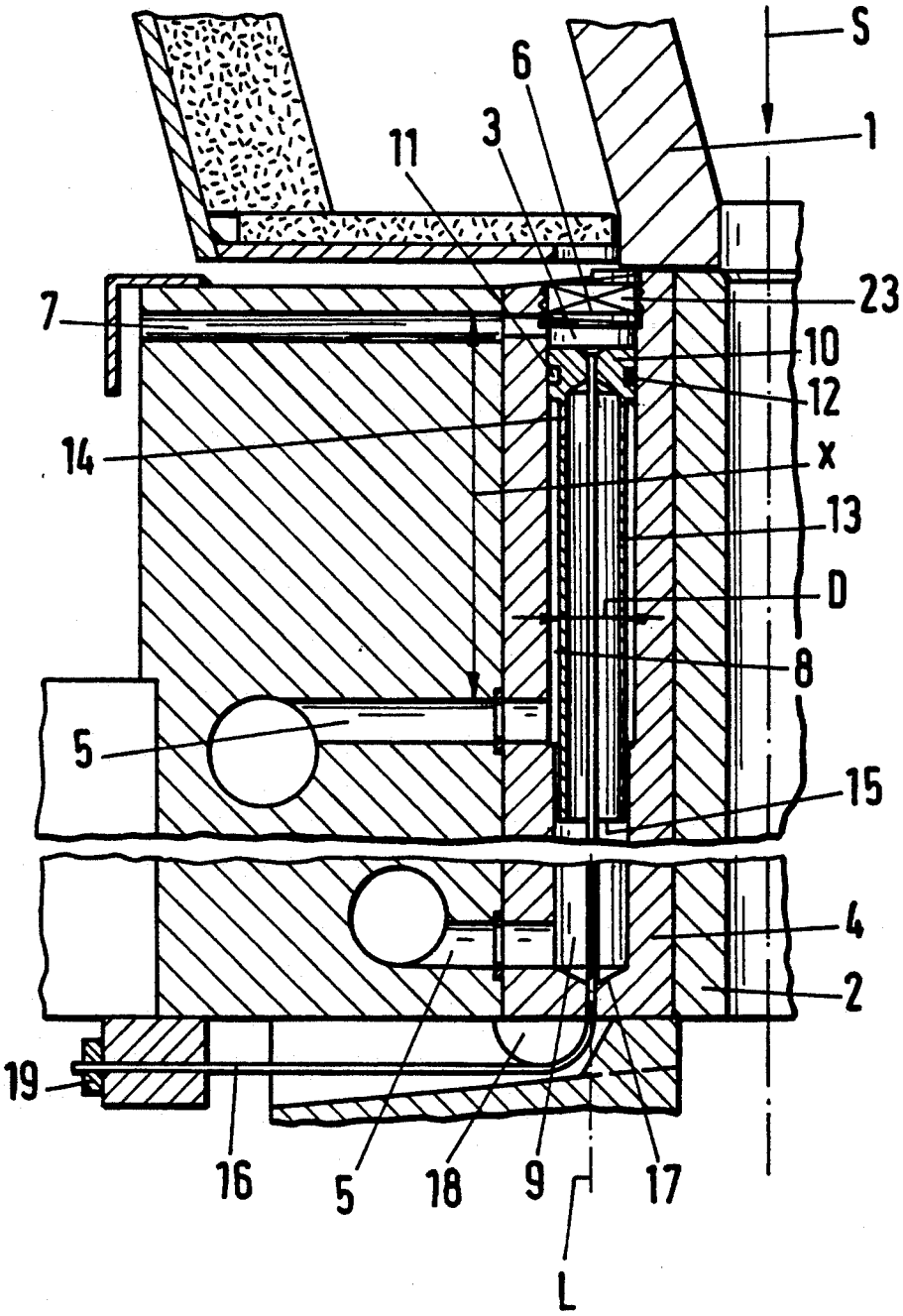
FIG. 1 is a longitudinal section through a continuous casting mold of the present invention having a hot top thereon.

FIG. 1 shows a continuous casting mold for the casting of nonferrous metal strips, with a so-called hot top 1 above it. The hot top 1 is connected directly to a mold wall 2. The mold wall 2 is fastened on a support plate 4 containing a channel 3. The channel 3 has a circular cross section and is provided with coolant connections 5 and with a pressure equalization hole 7, located, seen in direction of casting, on the upper end 6, outside the coolant flow path in the channel 3. This pressure equalization hole allows heated gas to expand, allows venting of any coolant which leaks around the stopper, and prevents the stopper 10 from generating a pressure differential in this space due to movement. The channel 3 has a region 8 of larger cross section and an adjoining region 9 of smaller cross section. The coolant connections 5 are arranged, in each case, on the side of the regions 8, 9 distal from the upper end 6 of the channel 3. A stopper 10, displaceable in the longitudinal direction L of the channel 3, is arranged in the region 8 of larger cross section. The stopper 10 is shaped to correspond to the inside cross section of the region 8 of the channel 3, so that the coolant does not flow beyond the stopper 10. Furthermore, the stopper 10 is provided with a circumferential groove 11 in which a packing 12 is placed, which assists in sealing the coolant in the space below the stopper 10. A tube 13 is connected to the side of the stopper 10 facing distal from the upper end 6. The tube 13 is provided with at least one opening 14 in the vicinity of the stopper 10, to allow coolant to flow from the space inside to the space outside the tube 13. This opening 14 should be as close to the stopper 10 as practicable in order to minimize the dead space. The tube 13 has an outside diameter D which is adapted to fit the inside cross section of the region 9, somewhat snugly. Furthermore, the end 15 of the tube 13 which faces away from the stopper extends in every position of displacement into the region 9 of the cooling channel 3 thus forming two coaxial spaces. This arrangement allows the coolant to flow into one of the coolant connections, through the inner space of the tube 13, without substantial leakage into the space between the tube 13 and the surrounding space of the region 9. The coolant flows through the opening 14 in the tube 13 to the space outside the tube 13 and inside the region 8. The stopper 10, with packing 12 prevents the coolant from entering the space of the channel 3 on the side of the stopper 10 distal from the tube 13 which is in communication with the pressure equalization hole 7. The coolant then flows through the space 8 outside the tube 13 to the other coolant connection 5. The presence of the snugly fitting tube 13 in the region 9 prevents flow of coolant directly between the coolant connections 5.

The displacement path of the stopper 10 is described by the measurement x. A displacement means 16 which acts on the stopper 10, passes through the tube 13 and is brought out of the support plate 4 at the lower end 17 of the channel 3. The displacement means 16, which may be, for instance, a pull rope or a cable, extends via a deflection element 18, which may be a pulley or contoured slider plate, laterally with respect to the direction of the emerging cast metal in the casting direction S, to a displacement device 19.

Figure 2:
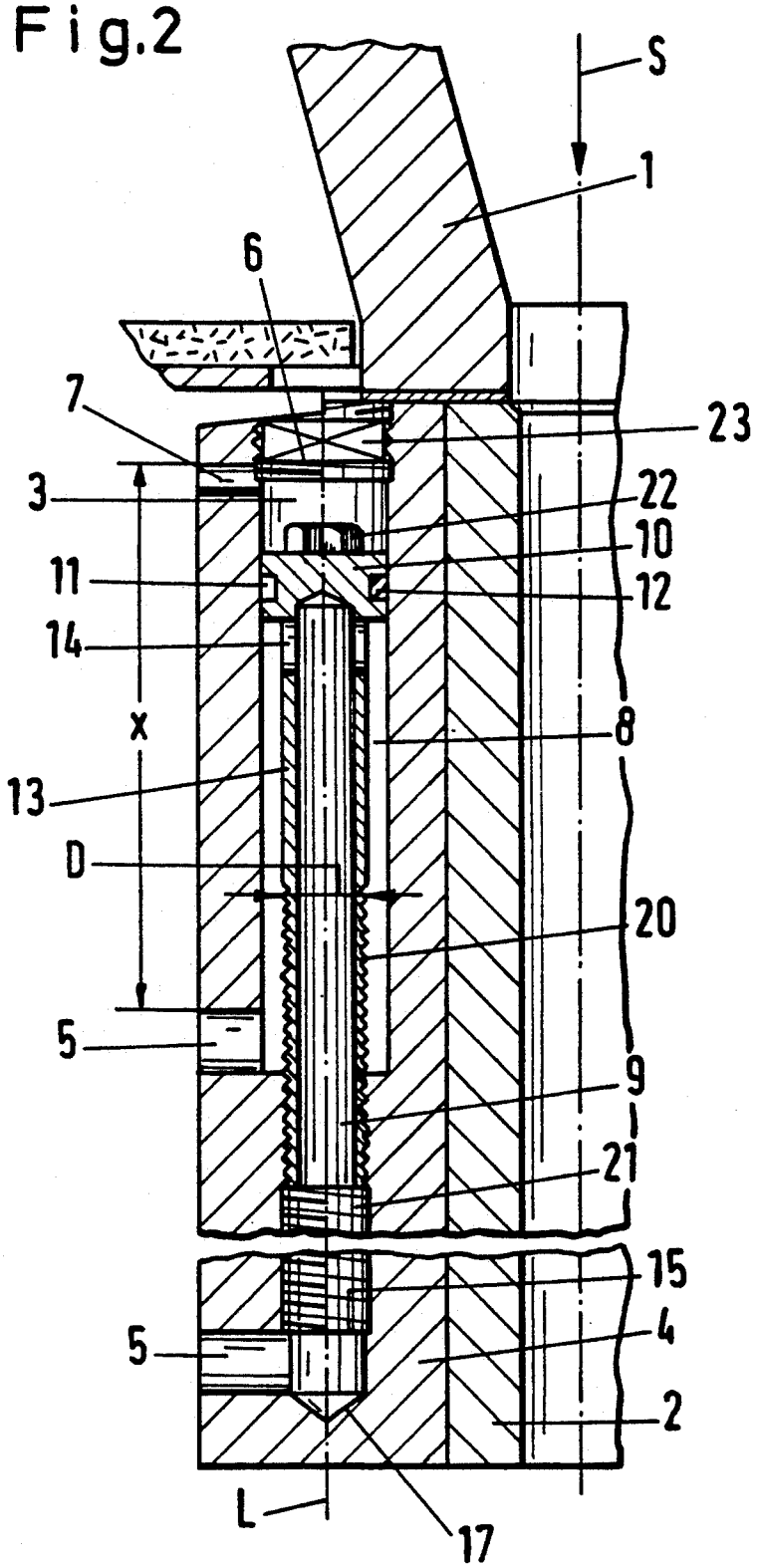
FIG. 2 is an enlarged view of a portion of FIG. 1 with another displacement mechanism in accordance with the present invention.

FIG. 2 shows an enlarged portion of FIG. 1 in the region of the channel 3, with a displacement mechanism according to a different embodiment of the present invention. The tube 13 is provided with an external helical thread 20 on the end thereof distal with respect to the stopper 10 in the region 9. The external helical thread 20 is in engagement with an internal helical thread 21, which is formed in the wall section of the narrow region 9 of the channel 3. A hexagonal head 22 is arranged on the stopper 10, by which the stopper 10 can be turned, which in turn twists the tube 13. Thus, the longitudinal displacement of the stopper 10 may be adjusted by rotating the hexagonal head 22, which turns the tube 13, causing relative movement between the helical threads 20, 21 and, thus, the desired displacement in the longitudinal direction L of the channel 3. The hexagon head 22 can be accessed from the outside through the channel 3 after removal of a closure 23 on the upper end 6 of the channel 3. It is understood that the stopper may be positioned by other known methods according to the present invention.

Within the meaning of the invention, the expression "tubes", shown with circular cross section in the drawings, are also meant to include tubes having square or polygonal cross sections. Of course it should be understood that the channel 3 consisting of the region 8 of larger cross section and an adjoining region 9 of smaller cross section must be adapted to accommodate any non-circular cross section tube, and that the helical threads 20, 21 would be inappropriate unless there were circular threaded inserts and a linking mechanism to allow adjustment.

It should also be understood that the present invention is to be subject to control systems which are known or obvious to those skilled in the art from the foregoing description. This control mechanism may include temperature sensors for the coolant, mold and cast metal exiting from the mold, coolant pressure and flow sensors, sensors for determining the properties of the cast metal and a displacement sensor for determining the position of the stopper 10 in the channel 3. The displacement x may be controlled in open loop or closed loop fashion, and may be provided with various control algorithms known to those skilled in the art. The present invention may be combined with other known cooling methods, to achieve various obvious advantages.

It should be understood that the preferred embodiments and examples described above are for illustrative purposes only and are not to be construed as limiting the scope of the present invention, which is properly delineated only in the appended claims.

What is claimed is:

1. A continuous casting mold, having a direction of casting, with adjustable cooling for the casting of metal, comprising:

a mold wall defining a mold cavity which is surrounded by at least one channel, said channel having a cross section and a longitudinal axis approximately aligned in the direction of casting, said channel further having first and second coolant connections; and a stopper, for blocking a flow of coolant, having a shape corresponding to said cross section of said channel, said stopper being mounted within said channel so as to be slidable along said longitudinal axis to define an adjustable length coolant-conducting channel within said channel, said coolant connections being located on the same side of said stopper, outside said adjustable length coolant-conducting channel.

2. The continuous casting mold according to claim 1, wherein said channel comprises a first region having a cross sectional area and a second region having a larger cross sectional area, wherein said stopper is arranged in said second region having said larger cross sectional area.

3. The continuous casting mold according to claim 2, wherein one of said first and second coolant connections is associated each with said first and said second regions.

4. The continuous casting mold according to claim 2, wherein said stopper divides said channel into said coolant-conducting channel and a distal portion, said distal portion comprising a pressure equalization hole.

5. The continuous casting mold according to claim 1, wherein said stopper comprises a circumferential groove and a packing inserted in said groove.

6. A continuous casting mold comprising a mold wall defining a mold cavity which is surrounded by at least one channel, said channel having a cross section and a longitudinal axis approximately aligned in the direction of casting, said channel further having first and second coolant connections; and a stopper, for blocking a flow of coolant, having a shape corresponding to said cross section of said channel, said stopper being mounted within said channel so as to be slidable along said longitudinal axis to define an adjustable length coolant-conducting channel within said channel, said coolant connections being located on the same side of said stopper, outside said adjustable length coolant-conducting channel;

and further comprising a flow directing means for directing a flow of coolant in said coolant-conducting channel from said first coolant connection, toward said stopper, and then toward said coolant connection, wherein said flow directing means comprises a tube which is attached to said stopper and extends longitudinally over a portion of said channel, said tube having an aperture for passage of coolant at a region in proximity to said stopper.

7. The continuous casting mold according claim 6, wherein said channel comprises a first region having a cross sectional area and a second region having a larger cross sectional area, wherein said stopper is arranged in said second region having said larger cross sectional area, and said tube has an external profile which corresponds to said cross section of said first region having a cross sectional area smaller than said second region.

8. The continuous casting mold according to claim 7, wherein said tube has an external helical thread and said portion of said channel has an internal thread, said internal thread and said external thread corresponding to each other, such that a rotation of said tube within said portion causes a longitudinal displacement of said stopper with respect to said channel.

9. The continuous casting mold according to claim 6, wherein said tube has an external helical thread and said portion of said channel has an internal thread, said internal thread and said external thread corresponding to each other, such that a rotation of said tube within said portion causes a longitudinal displacement of said stopper with respect to said channel.

10. A continuous casting mold comprising a mold wall defining a mold cavity which is surrounded by at least one channel, said channel having a cross section and a longitudinal axis approximately aligned in the direction of casting, said channel further having first and second coolant connections; and a stopper, for blocking a flow of coolant, having a shape corresponding to said cross section of said channel, said stopper being mounted within said channel so as to be slidable along said longitudinal axis to define an adjustable length coolant-conducting channel within said channel, said coolant connections being located on the same side of said stopper, outside said adjustable length coolant-conducting channel;

and further comprising a displacement means for displacing said stopper longitudinally in said channel, said displacement means passing through said coolant-conducting channel and being associated with a displacement device which is located outside said coolant-conducting channel, wherein said displacement means comprises a flexible member which acts on said stopper to guide it along said longitudinal axis and is deflected and guided along a path perpendicular to said longitudinal axis by a deflection means.

11. A continuous casting mold comprising a mold wall defining a mold cavity which is surrounded by at least one channel, said channel having a cross section and a longitudinal axis approximately aligned in the direction of casting, said channel further having first and second coolant connections;

a stopper, for blocking a flow of coolant, having a shape corresponding to said cross section of said channel, said stopper being mounted within said channel so as to be slidable along said longitudinal axis to define an adjustable length coolant-conducting channel within said channel; said coolant connections being located on the same side of said stopper, outside said adjustable length coolant-conducting channel;

wherein said stopper divides said channel into said coolant-conducting channel and a distal portion comprising a pressure equalization hole.

12. A continuous casting mold, having a direction of casting, with adjustable cooling for the casting of metal, comprising:

a mold wall defining a mold cavity which is surrounded by at least one channel, said channel having a cross section and a longitudinal axis approximately aligned in the direction of casting, said channel further having first and second coolant connections; and a stopper, for blocking a flow of coolant, having a shape corresponding to said cross section of said channel, said stopper being mounted within said channel so as to be slidable along said longitudinal axis to define an adjustable length coolant-conducting channel within said channel, said coolant connections being located on the same side of said stopper, outside said adjustable length coolant-conducting channel, said stopper comprising a circumferential groove and a packing inserted in said groove;

said channel comprising a first region having a cross-sectional area and a second region having a larger cross-sectional area, wherein said stopper is arranged in said second region having said larger cross-sectional area, one of said first and second coolant connections being associated each with said first and second regions;

a flow directing means for directing a flow of coolant in said coolant-conducting channel, the flow directing means comprising a tube attached to said stopper and extending longitudinally over a portion of said channel, said tube having an aperture for passage of coolant at a region in proximity to said stopper, said tube having an external profile which corresponds to said cross-section of said first region having a cross-sectional area smaller than said second region; and a displacement means for displacing said stopper longitudinally in said channel, said displacement means extending through said coolant-conducting channel and being associated with a displacement device which is located outside said coolant-conducting channel, said displacement means comprising a flexible member which acts on said stopper to guide it along said longitudinal axis and is deflected and guided along a path perpendicular to said longitudinal axis by a deflection means.

* * * * *